US008727565B2

(12) United States Patent
Domagala et al.

(10) Patent No.: US 8,727,565 B2
(45) Date of Patent: May 20, 2014

(54) LED LIGHTING DEVICES HAVING IMPROVED LIGHT DIFFUSION AND THERMAL PERFORMANCE

(75) Inventors: Thomas W. Domagala, Cottage Grove, MN (US); Steven C. Furlong, Maple Grove, MN (US)

(73) Assignee: James L. Ecker, Brooklyn Park, MN (US)

( * ) Notice: Subject to any disclaimer, the term of this patent is extended or adjusted under 35 U.S.C. 154(b) by 354 days.

(21) Appl. No.: 13/187,123

(22) Filed: Jul. 20, 2011

(65) Prior Publication Data

US 2011/0273881 A1 Nov. 10, 2011

Related U.S. Application Data

(63) Continuation-in-part of application No. 12/807,720, filed on Sep. 13, 2010.

(60) Provisional application No. 61/276,447, filed on Sep. 14, 2009.

(51) Int. Cl.

| | |
|---|---|
| ***F21V 7/00*** | (2006.01) |
| ***F21V 29/00*** | (2006.01) |
| ***F21S 4/00*** | (2006.01) |

(52) U.S. Cl.

USPC ..... 362/235; 362/241; 362/247; 362/249.02; 362/294

(58) Field of Classification Search

USPC ..... 362/235, 241, 247, 249.02, 294

See application file for complete search history.

(56) References Cited

U.S. PATENT DOCUMENTS

| | | | |
|---|---|---|---|
| 5,857,767 | A | 1/1999 | Hochstein |
| 6,045,240 | A | 4/2000 | Hochstein |
| 6,234,648 | B1 | 5/2001 | Borner et al. |
| 6,502,956 | B1 | 1/2003 | Wu |

(Continued)

FOREIGN PATENT DOCUMENTS

| | | | |
|---|---|---|---|
| WO | WO 2009/048956 | A2 | 4/2009 |
| WO | WO 2010/015820 | A1 | 2/2010 |

OTHER PUBLICATIONS

International Search Report and Written Opinion of the International Searching Authority for application PCT/US2011/028139, Jun. 20, 2011, 17 pages.

Photos of LT Solutions' light product sold May 25, 2010, 1 page.

*Primary Examiner* — Stephen F Husar

*Assistant Examiner* — James Cranson, Jr.

(74) *Attorney, Agent, or Firm* — Skaar Ulbrich Macari, P.A.

(57) ABSTRACT

A white light LED-based lighting device may comprise a light assembly including a plurality of white-light LEDs disposed on a substrate. The LEDs may cover the substrate top surface in a density of greater than 50 individual LEDs per square inch. An electrical driver board is electrically connected to the LEDs. A heat sink is thermally connected to the substrate and the LEDs. A reflector assembly may be disposed on the heat sink such that its focal plane is disposed generally adjacent to the LEDs. The device may have a continuous operating temperature of 65 degrees Celsius or lower in a room temperature environment. The LEDs may comprise a top surface area of less than 2 $mm^2$ and be arranged in a series of concentric rings on the substrate with each LED oriented along the circumference thereof. The reflector assembly may be filled at least partially with an impact-resistant polymer material.

20 Claims, 9 Drawing Sheets

(56) References Cited

U.S. PATENT DOCUMENTS

| | | | | |
|---|---|---|---|---|
| 6,517,218 | B2 | 2/2003 | Hochstein | |
| 6,688,753 | B2 | 2/2004 | Calon et al. | |
| 6,700,136 | B2 | 3/2004 | Guida | |
| 6,998,281 | B2 | 2/2006 | Taskar et al. | |
| 7,161,311 | B2 | 1/2007 | Mueller et al. | |
| 7,350,936 | B2 | 4/2008 | Ducharme et al. | |
| 7,352,138 | B2 | 4/2008 | Lys et al. | |
| 7,367,692 | B2 | 5/2008 | Maxik | |
| 7,385,359 | B2 | 6/2008 | Dowling et al. | |
| 7,462,997 | B2 | 12/2008 | Mueller et al. | |
| 7,658,513 | B2 | 2/2010 | Peck | |
| 7,824,076 | B2 | 11/2010 | Koester | |
| 7,874,703 | B2 | 1/2011 | Shastry et al. | |
| 7,972,040 | B2 | 7/2011 | Li et al. | |
| 8,070,328 | B1 | 12/2011 | Knoble et al. | |
| 8,172,434 | B1 * | 5/2012 | Olsson | 362/346 |
| 2002/0181231 | A1 | 12/2002 | Luk | |
| 2005/0052378 | A1 | 3/2005 | Hacker | |
| 2009/0046457 | A1 | 2/2009 | Everhart | |
| 2009/0161356 | A1 | 6/2009 | Negley et al. | |
| 2009/0275157 | A1 | 11/2009 | Winberg et al. | |
| 2010/0165001 | A1 | 7/2010 | Savvateev et al. | |
| 2010/0188001 | A1 | 7/2010 | Broitzman et al. | |
| 2010/0204841 | A1 * | 8/2010 | Chemel et al. | 700/282 |

* cited by examiner

LED LIGHTING DEVICES HAVING IMPROVED LIGHT DIFFUSION AND THERMAL PERFORMANCE

PRIORITY

This application is a continuation-in-part of U.S. patent application Ser. No. 12/807,720, filed Sep. 13, 2010, which claims the benefit of U.S. Provisional Patent Application Ser. No. 61/276,447, filed Sep. 14, 2009, the disclosures of both of which are hereby incorporated herein by reference in their entirety.

FIELD

The present invention is directed generally to lighting devices, and more particularly to white light LED-based lighting devices with high luminous output, improved light dispersion characteristics and/or improved thermal performance.

BACKGROUND

Energy conservation, in all its varied forms, has become a national priority of the United States as well as the rest of the world, from both the practical point of view of limited natural resources and recently as a security issue to reduce our dependence on foreign oil. A large proportion (some estimates are as high as one third) of the electricity used in residential homes in the United States each year goes to lighting. The percentage is much higher for businesses, street lights, and other varied items. Accordingly, there is an ongoing need to provide lighting which is more energy efficient.

It is well known that incandescent light bulbs are very energy inefficient light sources - - - about ninety percent of the electricity they consume is released as heat rather than light. This heat adds to the cooling load of a system during cooling season. In heating season the cost per BTU of heat that the lights give off is typically more expensive than the cost per BTU of the main heat source. The heat that is given off by the lighting also can cause "over shooting" of the desired temperature which wastes energy and makes the space feel uncomfortable. Fluorescent light bulbs are more efficient than incandescent light bulbs (by a factor of about four) but are still quite inefficient as compared to solid state light emitters, such as light emitting diodes (LEDs).

In addition, as compared to the normal lifetimes of solid state light emitters, incandescent light bulbs have relatively short lifetimes, i.e., typically in the range of 750 to 2000 hours. Fluorescent bulbs have longer lifetimes (e.g., 8,000 to 20,000 hours), but provide less favorable color reproduction and contain hazardous mercury. In dramatic comparison, the lifetime of light emitting diodes, for example, can generally be measured in decades (approximately 50,000 hrs or more).

One established method of comparing the output of different light generating sources has been coined color reproduction. Color reproduction is typically given numerical values using the so-called Color Rendering Index (CRI). CRI is a relative measurement of how the color rendition of an illumination system compares to that of a blackbody radiator, i.e., it is a relative measure of the shift in surface color of an object when lit by a particular lamp. The CRI equals 100 if a set of test colors being illuminated by an illumination system are the same as the results as being irradiated by a blackbody radiator. Daylight has the highest CRI (100), with incandescent bulbs being relatively close (about 95), and fluorescent lighting being less accurate (70 to 85). Certain types of specialized lighting devices have relatively low CRIs (e.g., mercury vapor or sodium, both as low as about 40 or even lower). Sodium lights are used, for example, to light highways and surface streets. Driver response time, however, significantly decreases with lower CRI values (for any given brightness, legibility decreases with lower CRI).

A practical issue faced by conventional lighting systems is the need to periodically replace the lighting devices (e.g., light bulbs, fixtures, ballasts, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on a typical usage of 6 hours per day for 20 years). In contrast, light-producing device lifetimes are typically much shorter, thus creating the need for periodic change-outs. The potential number of residential homes that may be candidates for these periodic change-outs of the traditional incandescent lighting systems, including base fixtures and lamps themselves, may be extremely large and represent an attractive commercial enterprise. For example, in the United States alone new residential home construction has an average of approximately 1.5 million dwellings per year over the last 30 years. Including older homes built before 1979, this represents at least 100 million residential dwellings that are candidates for potential upgrades to more energy efficient LED-based lighting systems.

Accordingly, for these and other reasons, efforts have been ongoing to develop ways by which solid state light emitters can be used in place of incandescent lights, fluorescent lights and other light-generating devices in a wide variety of applications. In addition, where solid state light emitters are already being used, efforts are ongoing to provide solid state light emitter-containing devices which have improved energy efficiency, color rendering index (CRI), contrast, and useful lifetime.

Light emitting diodes are well-known semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when an electrical potential difference is applied across a p-n junction structure. There are a number of well-known ways to make light emitting diodes and many associated structures, and the present invention can employ any such manufacturing technique.

The commonly recognized and commercially available light emitting diodes that are sold, for example, in electronics stores typically represents a "packaged" device made up of a number of parts. These packaged devices typically include a semiconductor-based light emitting diode and a means to encapsulate the light emitting diode. As is well known, a light emitting diode produces light by exciting electrons across the band gap between a conduction band and a valence band of a semiconductor active (light-emitting) layer. The electron transition generates light at a wavelength that depends on the band-gap energy difference. Thus, the color of the light (usually expressed in terms of its wavelength) emitted by a light emitting diode depends on the semiconductor materials embedded in the active layers of the light emitting diode.

Although the development of solid state light emitters, e.g., light emitting diodes, has in many ways revolutionized the lighting industry, some of the characteristics of solid state light emitters have presented challenges, some of which have not yet been fully met. For example, the emission spectrum of any particular light emitting diode is typically concentrated around a single wavelength (as dictated by the light emitting diode's composition and structure), which is desirable for some applications, but not desirable for others, e.g., for providing lighting, given that such an emission spectrum typically provides a very low CRI.

Because light that is perceived as white is necessarily a blend of light of two or more colors (or wavelengths), no single light emitting diode can produce white light. "White light" emitting devices have been produced which have a light emitting diode structure comprising individual red, green and blue light emitting diodes mounted on a common substrate. Other "white light" emitting devices have been produced which include a light emitting diode which generates blue light and a luminescent material (typically, a phosphor) that emits yellow light in response to excitation by the blue LED output, whereby the blue and the yellow light, when appropriately mixed, produce light that is perceived by the human eye as white light.

A wide variety of luminescent materials are well-known and available to persons of skill in the art. For example, a phosphor is a luminescent material that emits a responsive radiation (typically visible light) when excited by a source of exciting radiation. In most instances, the responsive radiation has a wavelength, which is typically longer, than the wavelength of the exciting radiation. Other examples of luminescent materials include day glow tapes and inks, which glow in the visible spectrum upon illumination by ultraviolet light. Luminescent materials can be categorized as being down-converting, i.e., a material which converts photons to a lower energy level (longer wavelength) or up-converting, i.e., a material which converts photons to a higher energy level (shorter wavelength). Inclusion of luminescent materials in LED devices has typically been accomplished by adding the luminescent materials to a clear plastic encapsulating material (e.g., epoxy-based or silicone-based material).

As noted above, "white LED lights" (i.e., lights which are perceived as being white or near-white by the human eye) have been investigated as potential replacements for white light incandescent lamps. A representative example of a white LED light includes a package of a blue light emitting diode chip, made of gallium nitride (GaN), coated with a phosphor such as Yttrium Aluminum Garnet (YAG). In such an LED light, the blue light emitting diode chip produces a blue emission and the phosphor produces a yellow fluorescence on absorbing that blue emission. For instance, in some designs, white light emitting diodes are fabricated by forming a ceramic phosphor layer on the output surface of a blue light-emitting semiconductor light emitting diode. Part of the blue rays emitted from the light emitting diode pass through the phosphor, while another part of the blue rays emitted from the light emitting diode chip are absorbed by the phosphor, which becomes excited and emits a yellow ray. The part of the blue light emitted by the light emitting diode, which is transmitted through the phosphor, is mixed with the yellow light generated by the phosphor. The human eye perceives the mixture of blue and yellow light as white light.

In another type of LED lamp, a light emitting diode chip that emits an ultraviolet ray which is absorbed by a phosphor material that produces red (R), green (G) and blue (B) light rays. In such an "RGB LED lamp", the ultraviolet rays that have been radiated from the light emitting diode excites the phosphor, causing the phosphor to emit red, green and blue light rays which, when mixed, are perceived by the human eye as white light. Consequently, white light can also be obtained as a mixture of these light rays.

Designs have been realized in which existing LEDs and other electronics are assembled into an integrated housing fixture. In such designs, an LED or plurality of LEDs are mounted on a circuit board encapsulated within the housing fixture, and a heat sink is typically mounted to the exterior surface of housing fixture to dissipate heat generated from within the device, the heat being generated by inefficient AC-to-DC conversion from within the device. Although devices of this type can generate white light by any of the means described above, their external geometry typically does not permit direct functional replacement of existing incandescent lighting systems currently installed in residential homes. For example, one such prior art device is described in the CREE Lighting Fixtures Inc. catalog as part number LR6. The LR6 embodiment includes an encapsulated LED structure with an external heat sink assembly integrated as part of a thermal management system. The necessity of an external heat sink assembly in conjunction with an integrated thermal management system adds significant cost to the device as compared to equivalent light output off-the-shelf incandescent devices. In addition, the incorporation of the external heat sink assembly adds significant weight to the device as well as yields an overall external geometry to the lamp which is cylindrical in nature, not at all similar to the familiar incandescent lamps. This unusual aesthetic appearance may be an impediment to market acceptance by the average home owner envisioning a direct swap-out.

In addition to the above drawbacks, currently available LED-based lighting devices do not appear to generate sufficient light output, at a cost competitive price, to be a direct lumen-for-lumen replacement for incandescent lighting devices. This may be one of the biggest reasons for current poor market penetration of white-light LED lighting devices into the residential marketplace.

Another drawback with conventional LED lamps is the undesirable creation of shadows and hot spots. For example, the light generated by the individual LED elements can be clearly seen by the human eye as a bright (hot) spot. These bright spots create corresponding bright/hot spots on surrounding surfaces being illuminated and the areas between these bright spots appear to be shadowed. This is in contrast to the relatively even dispersion of light generated by incandescent bulbs.

Yet a further drawback of conventional LED lamps is the need to design and manufacture a unique lamp system for each different size/shape and/or wattage of bulb. Some of the more common bulb shapes are American National Standards Institute (ANSI) PAR30, PAR 38, R20 and MR16. Thus, conventional LED lamps for each of these shapes typically have a proprietary light engine and housing. This results in additional engineering, parts and manufacturing costs.

Given the above-noted concerns, there is a need for an improved LED-based white light illumination device that overcomes, at least in part, the disadvantages of the prior art lighting systems, including the prior art LED-based lighting systems.

SUMMARY

Generally, the present invention is directed to lighting devices, systems and methods. In certain embodiments the invention is directed to white light LED-based lighting devices with improved light diffusion and thermal performance compared to conventional LED-based lighting devices. In one aspect of certain embodiments, a light assembly comprising a plurality of white-light LEDs may include a substrate having a generally planar top surface with a plurality of white-light LEDs disposed thereon. The LEDs may cover the substrate top surface in a density of greater than 50 individual LEDs per square inch. An electrical driver board is electrically connected to the plurality of white-light LEDs. A heat sink is thermally connected to the substrate and the plurality of white-light LEDs. The electrical driver board can be disposed at least partially within the heat sink.

In another aspect, the light assembly further comprises a reflector assembly including an inlet aperture, an outlet aperture, and defines a focal plane therein. The reflector assembly can be disposed on the heat sink such that the focal plane is disposed generally adjacent to the plurality of white-light LEDs.

In a further aspect, the light assembly may comprise a reflector assembly including an inlet aperture, an outlet aperture, an inside reflector surface and a focal plane defined therein. The reflector assembly may further define a horn angle between the inside reflector surface such that optical radiation emanating from the plurality of white-light LEDs reflects at least once off the inner surface of the optical reflector before exiting the outlet aperture.

In an additional aspect, the heat sink includes a circumferential outer surface and a circumferential flange extending outwardly from the circumferential outer surface. And in another aspect, the reflector assembly includes an inlet aperture with an inner circumferential surface sized and shaped to correspond to the outer circumferential surface of the heat sink for disposing the reflector assembly thereon.

In a further aspect, the present invention includes a reflector assembly being filled at least partially with an impact-resistant polymer material that is disposed on the heat sink.

In yet another aspect, the light assembly has a continuous operating temperature of 65 degrees Celsius or lower in a room temperature environment.

In another aspect, the plurality of white-light LEDs each comprises a planar area projection on the substrate of less than 2 $mm^2$. The LEDs are disposed in a series of concentric rings on the substrate with each LED having a major length being oriented along the circumference of the concentric rings.

Additional aspect, features and advantages of the present invention will be apparent from review of the entirety of this application. The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

The invention may be more completely understood in consideration of the following detailed description of various embodiments of the invention in connection with the accompanying drawings, in which.

Figure 1:
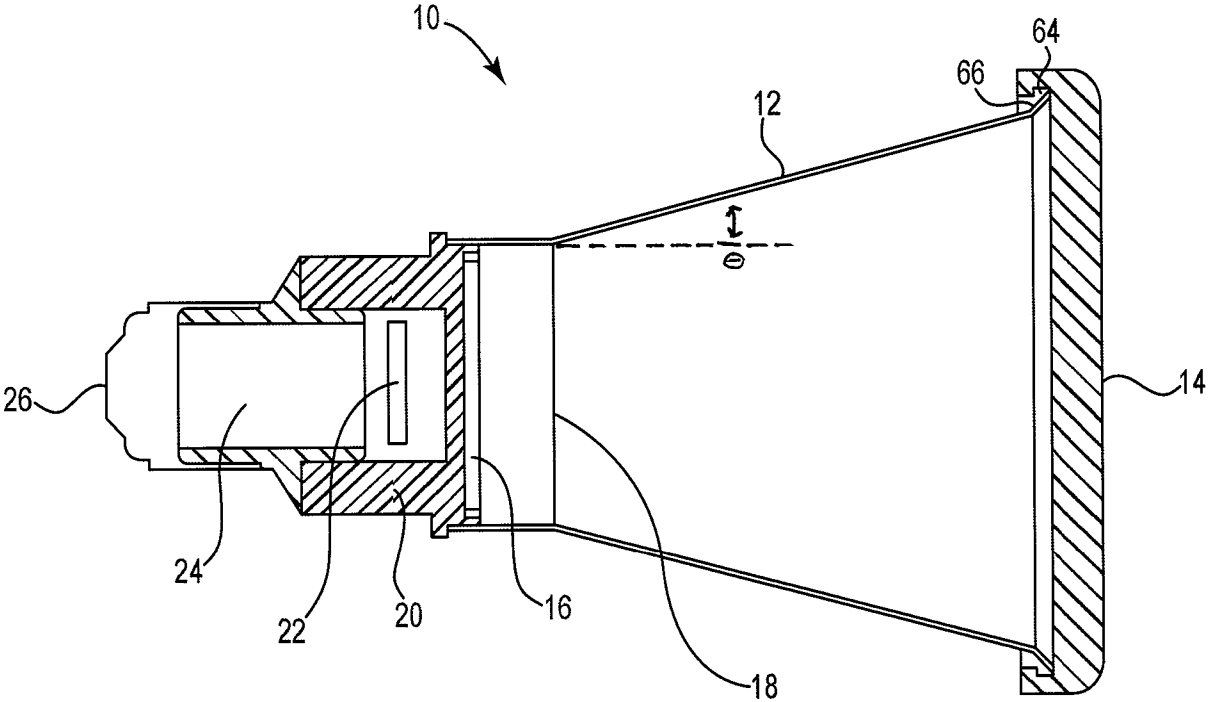
FIG. 1 is a schematic representation of one embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

In the following descriptions, the present invention will be explained with reference to example embodiments thereof. However, these embodiments are not intended to limit the present invention to any specific example, embodiment, environment, applications or particular implementations described in these embodiments. Therefore, description of these embodiments is only for purpose of illustration rather than to limit the present invention. It should be appreciated that, in the following embodiments and the attached drawings, elements unrelated to the present invention are omitted from depiction; and dimensional relationships among individual elements in the attached drawings, unless specifically claimed, are illustrated only for ease of understanding, but not to limit the actual scale and dimension.

In general, the present invention is directed to lighting devices, and more particularly to white light LED-based lighting devices with high luminous optical output and, according to certain embodiments, configured for energy efficient lumen-for-lumen replacement of existing incandescent lighting devices. In the context of the present invention the phrase "energy efficient lumen-for-lumen replacement" refers to white light LED-based lighting devices which consume less electrical energy than the incandescent lighting devices they are intended to replace, while simultaneously producing at least the same, if not more, luminous optical output.

Figure 1A:
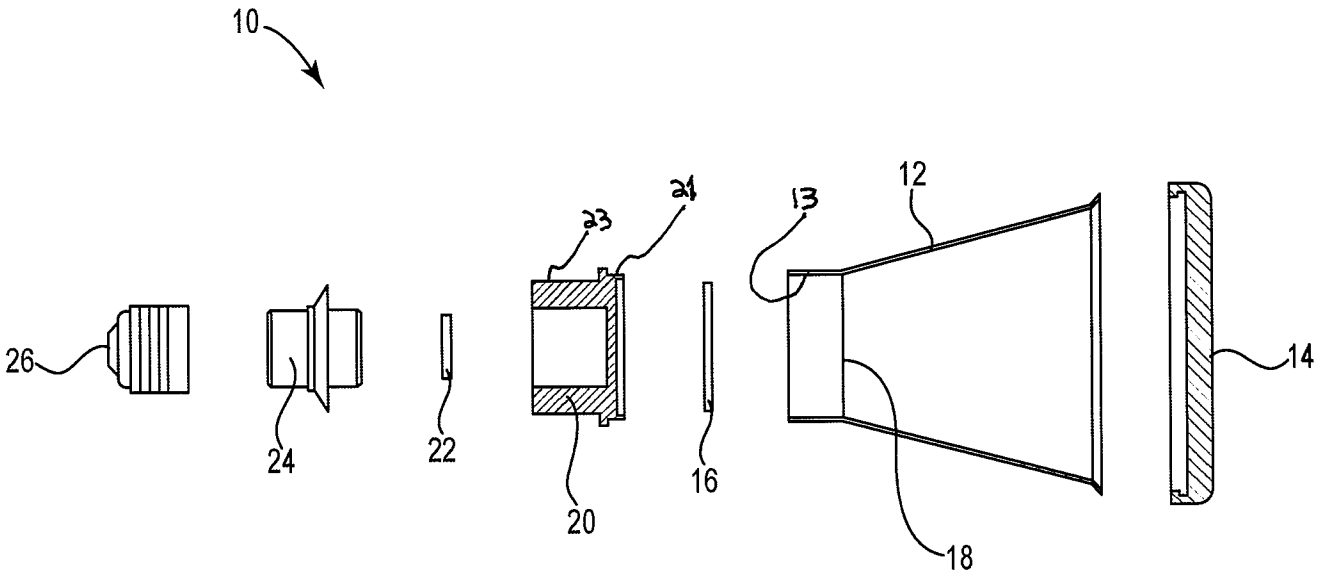
FIG. 1A is a breakout of the components shown fully integrated in FIG. 1.

One embodiment of a white light LED device 10 in accordance with the present invention is depicted schematically in FIG. 1. Incandescent light bulb devices with the shape depicted in FIG. 1 have generally been categorized by the American National Standards Institute (ANSI) as having part number PAR 30. Although the invention is not limited to the PAR 30 configuration. A break out of the components that comprise the white light LED device 10 depicted in FIG. 1, are shown in FIG. 1A, and it will be convenient to numerically label the components in the two figures consistently.

As shown in FIG. 1, the LED light device according to one embodiment includes a generally horn-shaped optical reflector 12 with diffusing element 14 attached thereto. Referring to FIGS. 4A, 4B, 5A and 5B, these structures can be seen in additional detail according to R20 and R30 shaped and sized examples. However it should be understood that the invention is not limited to just the shapes and dimensions discussed herein. On the contrary, the invention includes any shape and dimensions adaptable to the invention as covered by the claims.

It can be seen that the reflector 12 includes an outer surface 50 and an inner surface 52. The circular cone or horn-like shape extends between the open inlet end 54 and the open outlet end 56. A portion of side surface 58 spanning between the inlet end and the outlet end diverges as it extends in the direction of the outlet end. The diverging portion can be a straight line as shown in FIG. 4A, a curvature as shown in FIGS. 5A and 6A, a combination of straight line and curvature, or any other shape. The geometry of the reflector element will define a focal plane 18 generally between the inlet end 54 and the point that the diverging sidewall begins 54' and going in a direction from inlet to outlet.

Figure 4B:
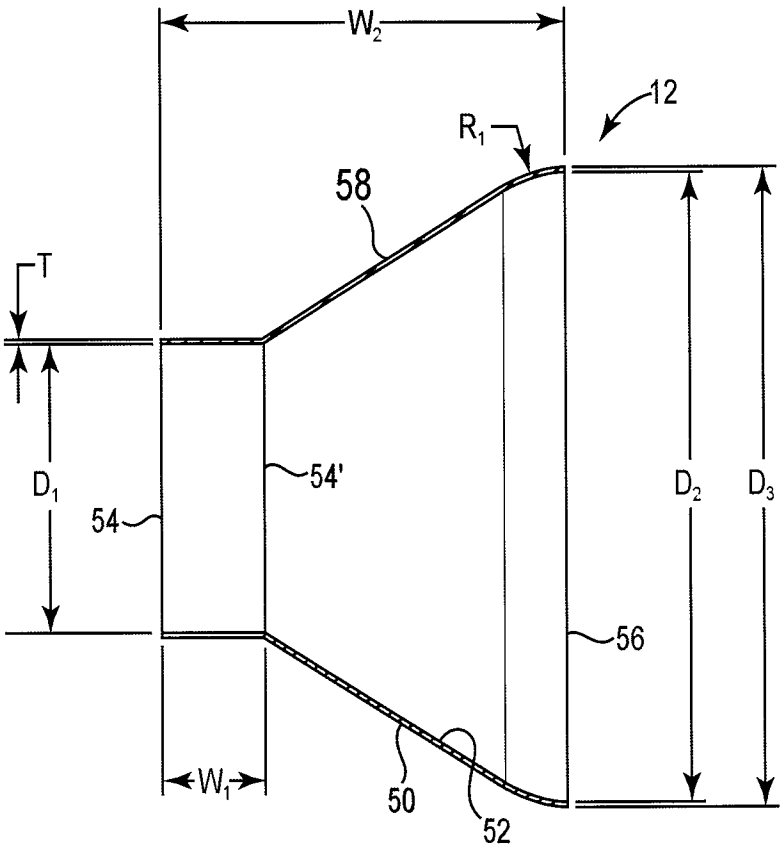
FIG. 4B is a side sectional view of a portion of FIG. 4A.
Figure 4A:
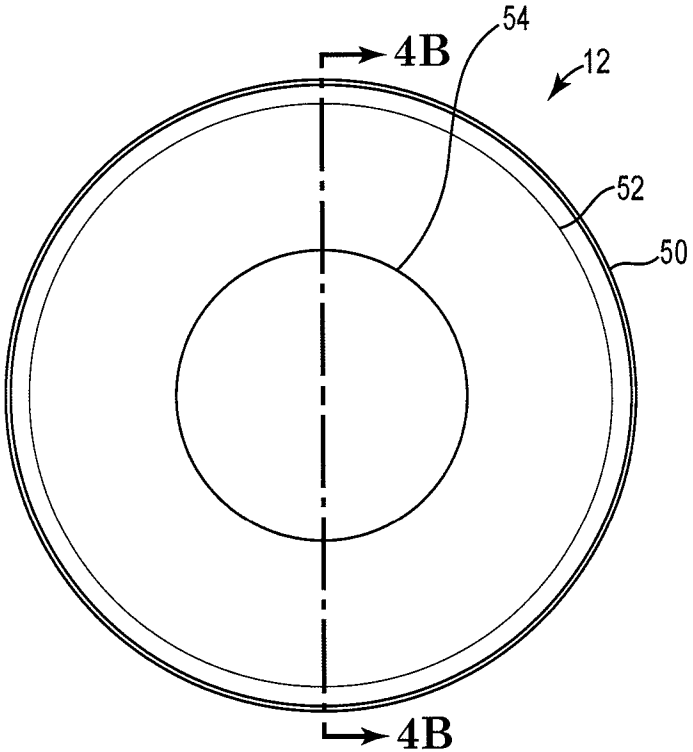
FIG. 4A is a front end view of a reflector according to an embodiment of the invention.

Referring specifically to FIGS. 4A and 4B, an R30 reflector 12 in accordance with an example embodiment of the invention is shown. The inner inlet diameter D1 is 1.795 inches. The material thickness T is 0.032 inches. The width of the inlet section $W_1$ is 0.625 inches. The overall width or depth $W_2$ of the reflector is 2.5 inches. The width of the diverging portion is therefore 1.875 inches. The inner diameter of the outlet $D_2$ is 3.811 inches with an outer diameter $D_3$ of 3.875 inches. A radius $R_1$ adjacent the outlet 56 has a curvature of 0.75 inches. All edges are radiused to reduce sharpness and increase safety.

Figure 5C:
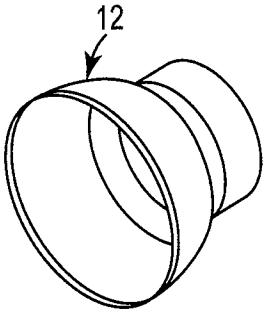
FIG. 5C is a perspective view of the reflector shown in FIGS. 5A and 5B.
Figure 5B:
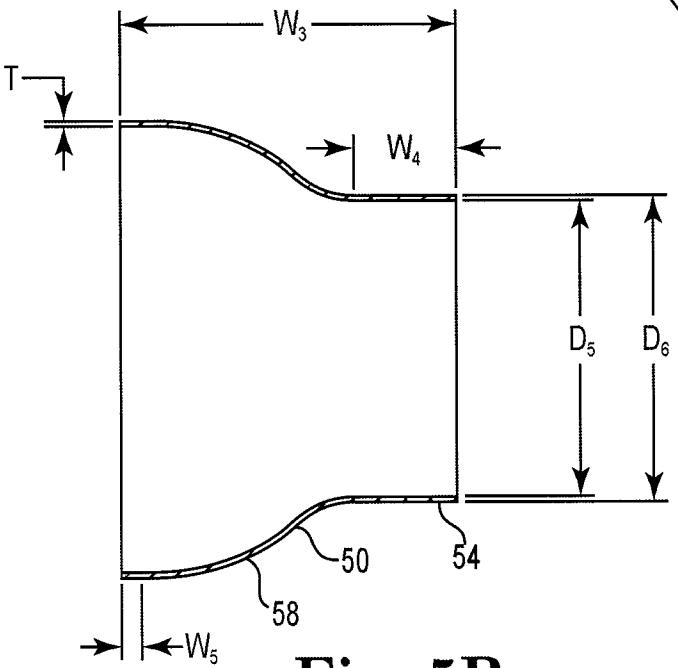
FIG. 5B is a side sectional view of a portion of FIG. 5A.
Figure 5A:
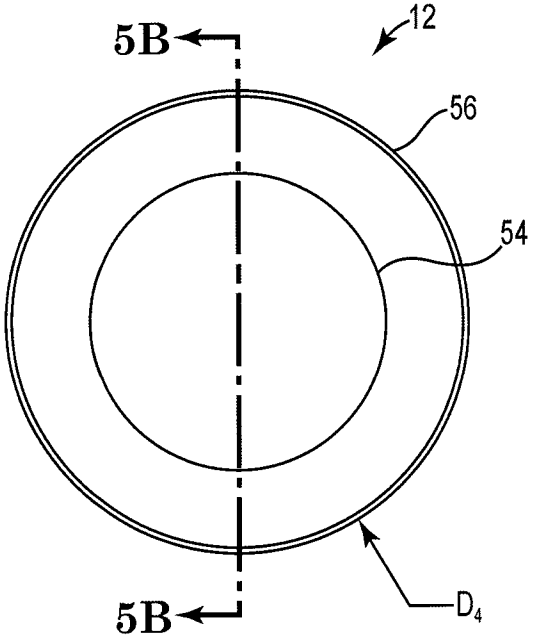
FIG. 5A is a front end view of a reflector according to an embodiment of the invention.

Referring specifically to FIGS. 5A, 5B and 5C, an R20 reflector 12 is shown. The diameter $D_4$ of the outlet is 2.80 inches. The width $W_3$ or depth of the reflector is 2.06 inches. The width $W_4$ of the inlet section is 0.625 inches. The width $W_5$ of a flange portion of the outlet section is 0.125 inches. The diameter $D_5$ of the inlet is 1.810 inches with an outside diameter of 1.874 inches. The thickness T is 0.032 inches. Again, all edges are radiused.

The reflector 12 may be fabricated from a variety of suitable materials. For example, the reflector can be formed of a metal such as aluminum. The inner surface can be polished to increase reflectivity. In another alternative, the reflector can be formed of a non-metal such as plastic, polymer or carbon fiber. In such cases, the non-metal material is metalized or coated on its inner surface with a metallic film yielding a high reflection co-efficient optimally approaching 90% or better. The reflector can also be formed from a combination of materials, including metal and non-metal combinations.

Figure 6B:
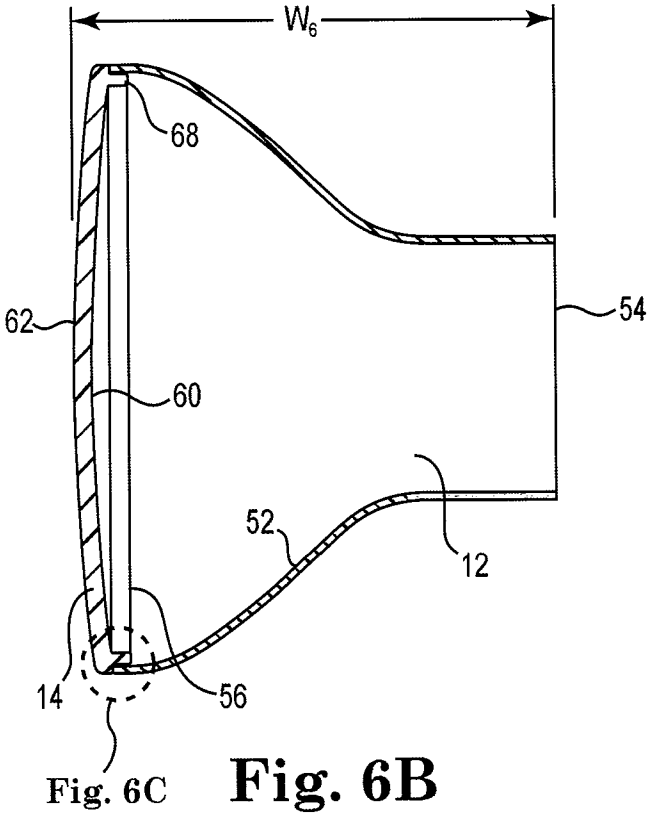
FIG. 6B is a side sectional view along line A-A of FIG. 6A.
Figure 6A:
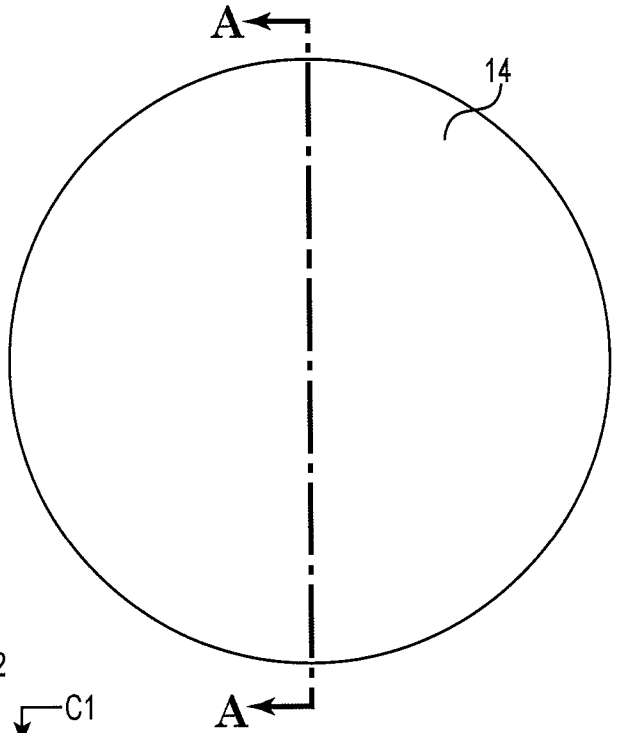
FIG. 6A is a front end view of a reflector with diffuser according to an embodiment of the invention.

Referring to FIGS. 1, 6A and 6B, the diffusing element 14 can be seen disposed on the outlet end 56 of the reflector 12. The diffuser can be clear, translucent or opaque, including colored. The diffuser generally functions to diffuse the light from the LED elements so that hot spots and shadows are eliminated. One or both of the inner surface 60 and outer surface 62 can be coated, roughened or receive micro-faceting to aid in the light diffusion performance. The diffuser can be formed of a plastic material or other material that transmits light. The diffuser can also be curved, such as the outwardly curving or convex shape shown in FIG. 6B in order to optimize the light diffusing effect. The curvature of the diffuser 14 in FIG. 6B provides an overall width $W_6$ of 2.23 inches to the depicted R20 configuration.

Figure 6C:
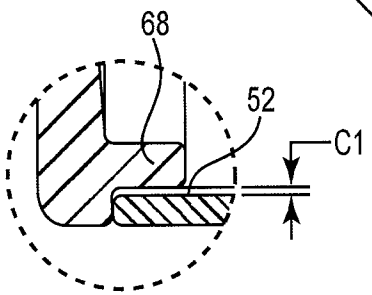
FIG. 6C is a sectional detail view of a portion of FIG. 6B.

The reflector 12 in FIG. 1 includes a recessed circumferential groove 64 that is sized to securely receive a flanged portion 66 of the reflector outlet in order to secure the diffuser to the reflector. In another example, as shown in FIGS. 6B and 6C, the diffuser includes a circumferential flange 68 that extends inwardly of the diffuser inner surface 60. The flange 68 engages the previously mentioned flange portion of the inner surface 52 of the reflector 12. As shown in detail FIG. 6C, there is a nominal clearance of 0.010 inches between the flange 68 and reflector inner surface 52. Glue can be applied to this clearance gap to enhance securement of the diffuser to the reflector. Other securement means such as ribs, clips and tabs can be utilized in addition to or in alternative to the secrurement means described herein. Combinations of any of the foregoing may also be utilized without departing from the scope of the invention.

Figure 2A:
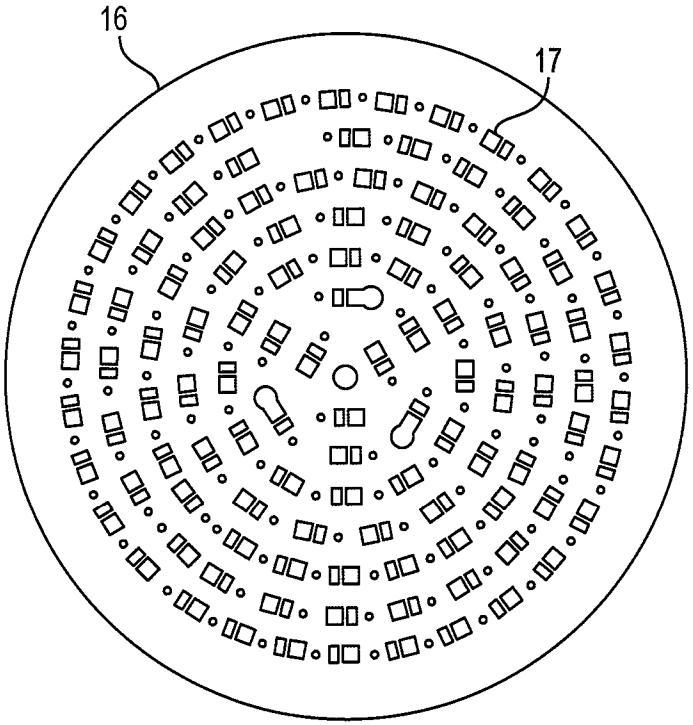
FIG. 2A is a schematic representation of the Light Emitting Diode (LED) array device.
Figure 2B:
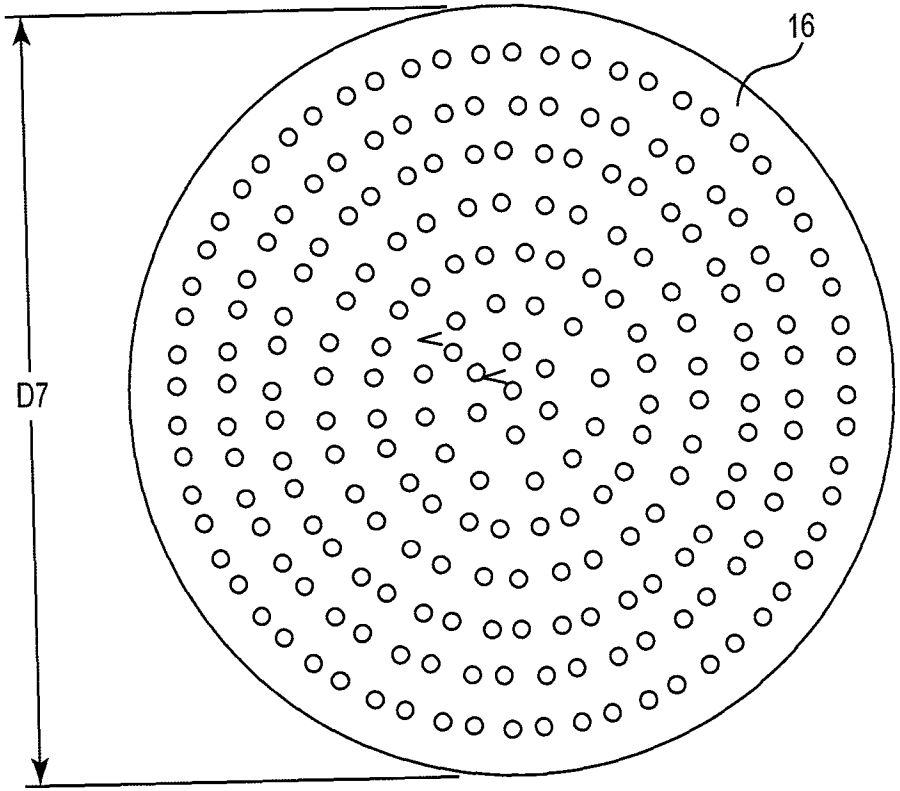
FIG. 2B is a drill schematic for an LED mounting substrate according to an embodiment of the invention.

The LED light assembly further comprises an LED array 16 as the light source. Referring to FIGS. 2A and 2B, the LED array 16 may comprise a substrate 16 having a plurality of individual discrete LEDs 17 adhered thereto. The substrate 16 can be formed of a suitable circuit electrical board material. The substrate in one embodiment has a diameter $D_7$ of 1.550 inches. In the aspect where the substrate is planar in cross-section, the surface area of the LED mounting side is thus approximately 1.887 inches. In other embodiments, the substrate can be curved and/or faceted. Other substrate dimensions may be employed without departing from the scope of the invention.

Figure 7:
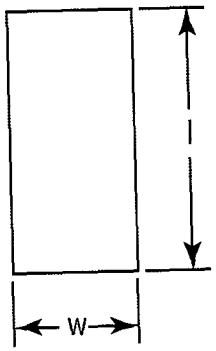
FIG. 7 is a top plan diagram view of an individual LED element according to an embodiment of the invention.

The individual LEDs 17 may be of a similar type, for example, same color temperature and power consumption, or the LEDs may be a mixture of different color temperature and/or power levels to customize and/or modify the output characteristics of the white light LED device 10. In one example embodiment, the individual LEDs are each CL824-series LEDs. As depicted in FIG. 7, these LEDs are each 0.8 mm wide (w)×1.6 mm long (l)×0.9 mm tall. Each has a nominal warm color temperature output rating of 4.6 lumens @20 mA and a nominal cool temperature output rating of 4.8 lumens @20 mA. Other suitable LED elements can be utilized without departing from the scope of the invention.

In one example embodiment, 111 individual LEDs 17 are mounted to a substrate 16 having a generally planar cross-section, thus forming an LED array. When the 111 LED elements are driven at 25 mA, the LED array has a total output of over 650 lumens. Thus, the Lumen per unit area of the array is greater than 344 lumens per square inch, and the number of LED elements per square inch of substrate top surface area (LED density) is greater than 50. Approximately 0.220 square inches of the array are covered by the LED elements, which is approximately 11.7% of the array surface area. Thus the ratio of substrate to LED coverage is less than 10 to 1. Also, in one embodiment, the LED array also has a power factor greater than 95% by the elimination of capacitors and/or inductive components.

One shortcoming of prior art LED lighting devices concerns "hot spots" or its counterpart "shadows" that are produced by conventional LED illumination devices. This uneven lighting effect is annoying to many people and is thought to be a deterrent to the widespread adoption of LED-based lighting devices. The present invention described herein above and below includes various means and methods to address the hot spot/shadow issue. Each of these means and methods can be utilized individually or in various combinations to provide an LED-based illumination device with improved hot-spot/shadow performance.

The use of a large number of relatively small individual LEDs in a relatively small area, as explained above, provides both light dispersion and heat management benefits, as well as other benefits, to the lighting device. For example, conventional LED devices typically use a small number of individual large high power LEDs to achieve the desired light output.

However, each of these individual LEDs must be quite bright (measured in lumens) to achieve the necessary output. Consequently, a person is able to easily observe the individual LED elements as hot spots when the light fixture is installed. The gaps between these hot spots is observed as shadows. This appearance can be off-putting, and potentially even dangerous, to the user depending on the use. Thus, many users will be reluctant to transition to the use of energy-efficient LED-based light devices. Attempts to diffuse the light generated by the large and bright LEDs has been unsatisfactory.

In contrast, the many small, densely-packed or arranged LEDs according to certain embodiments of the present invention reduce the user's perception of individual elements when lit and also reduces shadows. Yet, the desired luminosity can be achieved by employing a large number of LED elements.

Another consequence of utilizing a small number of large LED elements is the undesirable heat that the large elements generate. While LEDs are inherently quite efficient, large LED elements typically used in conventional light devices generate greater heat volumes than smaller-sized LEDs. And the relative heat output to size ratio is not linear. Thus, the heat output of a 650 lumen fixture utilizing nine LED elements will typically generate more heat than a 650 lumen fixture according to the present invention employing 111 LED elements. For example, the LED light assembly described herein according to the present invention has an operating temperature of less than 65 degrees Celsius (measured at heat sink 20) when employed in a room-temperature environment. Less heat generated allows for elimination of the heavy, expensive and often unattractive heat sink features of the conventional LED lights. Less heat generated also results in cooler operating temperatures for the LEDs, which has a beneficial effect on longevity. Longer lasting fixtures save the user money, reduces waste and reduces energy consumption over the long term.

Yet another consequence of the conventional use of a small number of large LED elements is a reduced or non-existent tolerance for failure of any one or more individual LED elements in the fixture. Since each such element is responsible for a relatively large portion of the overall output (e.g. 10% or more) and light footprint, the failure of even one element may render the entire fixture unusable or unsatisfactory for further use. Thus, the life span of the conventional fixture is only as long as the shortest-lived individual element.

In contrast, the use of small and densely-packed LED elements according to the present invention is far more tolerant of the failure of individual LED elements. For example, the failure of one, two or possibly more non-adjacent elements may not be readily perceptible to the average user. This is particularly the case when the diffuser described herein is employed. The result is that the useful lifespan of the LED light fixture according to the present invention is lengthened compared to that of conventional LED fixtures.

Figure 8:
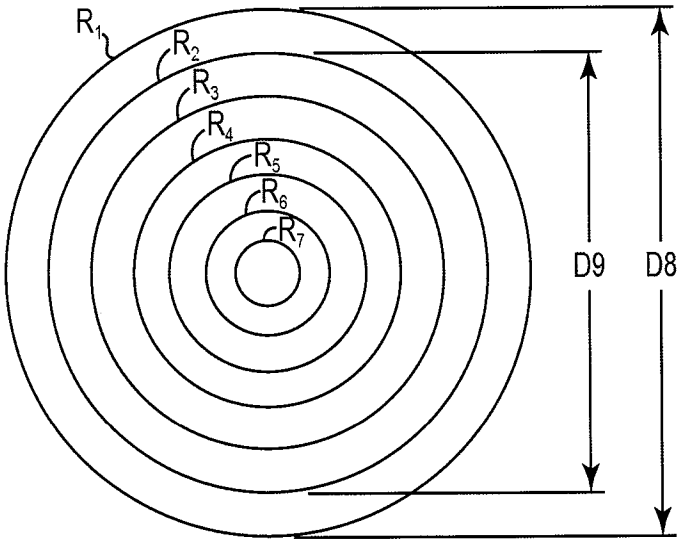
FIG. 8 is a top plan diagram of the orientation and spacing of individual LED elements according to an embodiment of the invention.

Referring to FIG. 2A, it can be seen that the individual LEDs are placed in a series of circumferential rings or circles with their major side lengths oriented along the rings. The rings are illustrated in the diagram of FIG. 8. In this example, there are 7 rings ($R_1$-$R_7$) of decreasingly small diameters starting with the outer ring $R_1$ and going inward to ring $R_7$. The outer ring $R_1$ has a diameter $D_8$ of 1.359 inches. Second ring $R_2$ has a diameter $D_9$ of 1.156 inches. Ring radial spacing can be uniform, varied or a combination thereof. Orientation along the series of circumferential rings helps to eliminate hot spots and aids in the diffusion of the light produced by the device. More or fewer numbers of rings can be utilized. FIG. 2B shows drill holes in the substrate that correspond to LED element placement and also provide a means for heat transmission through the substrate.

According to one aspect of the present invention, the geometrical relationship between the diameter of the LED array 16 ($\phi_{LED}$), the entrance aperture diameter and horn-angle Θ of the optical reflector 12 (shown in FIG. 1), and the spacing between the surface of the LED array 16 and the entrance aperture 18 of the optical reflector 12 are all simultaneously chosen to ensure that optical radiation emanating from the LEDs at angles greater than 30° reflect at least once off the inner surface of the optical reflector 12. This arrangement is beneficial to promote the efficient light generation and mixing/diffusion of said light by the light device or fixture 10.

In another aspect of the invention, an LED array 16 (shown in FIGS. 1, 1A and 2A) is located generally proximate to the entrance aperture 18 of the optical reflector 12. Light emitting diodes typically have optical radiation that spans a viewing angle on the order of 120 degrees (+/−60 degrees from head-on (normal) to its surface). Given this, the LED array on substrate 16 is optimally located generally proximate to the entrance aperture 18 of the optical reflector 12, and the diameter and horn angle Θ of the optical reflector 12 is sufficient to capture a large fraction of the light emanating from the LED array 16. This arrangement promotes efficient light output and mixing of the light to reduce the perception of hot spots and shadows.

In one example embodiment as generally outlined above, the LED elements 17 are disposed on a planar substrate 16, which is located generally proximate the focal plane of the optical reflector 12. In this embodiment, the focal plane of the optical reflector 12 may be located at or near the entrance aperture 18 of the optical reflector 12. The optical reflector 12 may be configured with an entrance aperture 18 of approximately 1.8 inches with a horn-angle Θ of approximately 30 degrees. In this geometrical configuration, the optical reflector 12 behaves as an optical mixer to simultaneously smooth out what might otherwise be hot spots and/or projected shadows.

Alternatively, interfacing the same LED array 16 described above with an optical reflector 12 configured with a horn angle Θ on the order of about 15 degrees, the optical reflector 12 may increase the projected light output in the far field (say, 20 to 30 feet from the white light LED device 10) by a factor 4× to 5× over the comparative case with a horn angle of 30 degrees. That is, the LED device 10 can be reconfigured from a flood light (30 degree horn angle) to a spot light (15 degree horn angle) by proper choice of the optical reflector 12. This aspect is particularly well suited for both residential and commercial applications, wherein sufficient optical energy is delivered for illumination of objects over reasonable distances with no hot-spots or shadows.

Figure 3A:
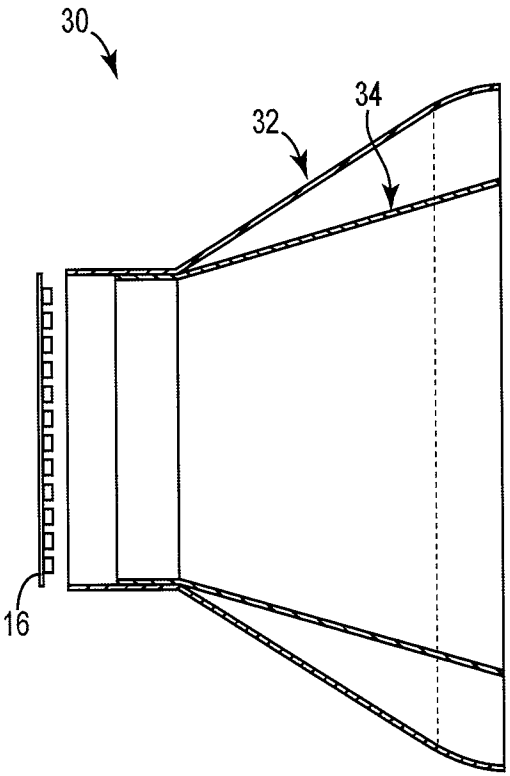
FIG. 3A is a side view of the reflector depicted in FIG. 3.
Figure 3:
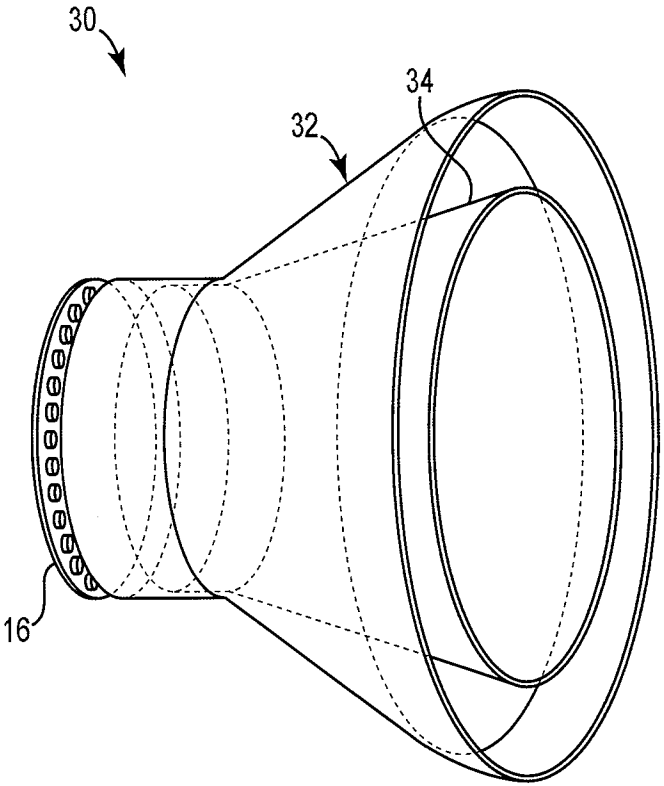
FIG. 3 is a schematic representation of a first outer horn-shaped reflector with an inner nested horn-shaped reflector with a shallower horn angle.

Referring specifically to FIGS. 3 and 3A depicting an LED lighting device 30 with a first outer horn-shaped reflector 32 with an inner nested horn-shaped reflector 34 with a shallower horn angle. Without the inner nested horn-shaped reflector 34 the LED lighting device 30 shown in FIG. 3 may function optically as a flood illuminator with light emanating from the LED lighting device 30 spanning an angle of +/−30 degrees. By inserting the inner nested horn-shaped reflector 34 with a shallower horn angle on the order of 15 degrees into the aforementioned LED lighting device 30, it can transform the "flood illuminator" into a "spot illuminator" which can project the illumination over a longer distance. This morphable feature allows re-purposing of the device when, for example, moving from a typical office space with a ceiling height of 9 to 10 feet and reinstalling into a typical warehouse setting where the ceiling may be as high as 30 feet and beyond and it is important to illuminate the floor surface over a much larger distance.

The array of individual LED elements 17 on substrate 16 can be sealed against environmental, including moisture, contamination by the application of a layer of conformal coating to the top surface of the substrate after the LEDs have been disposed thereon. A layer of polymer or acrylic coating over the conformal coating can be applied for further protection and/or thermal and optical properties to aid in heat dispersion and/or light diffusion.

In one example embodiment, each discrete LED may be individually driven by a unique electrical activation signal (from the electrical driver board 22) or groups of LEDs may be "ganged" together and driven by a common electrical activation signal. In this configuration, for example, the following aspects may be achieved:

1) By utilizing a plurality of discrete LEDs of different color temperatures with individualized electrical activation signals, and by varying the ratio of the electrical activation signals, the resultant color temperature at the output of the white light LED device 10 can be modified thereby by weighted "color mixing".
2) By utilizing a plurality of discrete LEDs with individualized electrical activation signals, the luminous optical output of the white light LED device 10 can be modified by varying the fraction of activating available LEDs. For example, a traditional three-way lighting device could be enabled in this embodiment by external command to sequentially activate 25%, 50%, or 100% of the available LEDs.
3) The electrical driver board 22 may be configured to accept remote infrared commands to vary the activation levels to the individual LEDs. In this embodiment, both of the options defined above could be realized by a homeowner, for example, with a hand-held remote control device to either vary the color temperature or light output level of the white light LED device 10.

Referring again to FIG. 1, thermal management, and the associated benefits this conveys as discussed above, can be enhanced by placing the LED array 16 in direct mechanical contact with heat sink assembly 20. The heat sink assembly 20 may comprise a passive metal or metal-like material or an active device such as a thermo-electric cooler, commonly referred to as a Peltier cooler. In the case of an active heat sink assembly 20, the electrical power would be supplied by the electrical driver board 22. The electrical driver board 22 is isolated from the external electrical connector 26 which screws into a standard light bulb socket by electrical insulating device 24.

Heat sink assembly 20 may also include air vents or corrugate fins to increase the effective surface area to conduct or transfer outwardly heat generated from within the white light LED device 10. The void 21 defined inside of the heat sink may be filled with a conductive epoxy to create a heat conduction path. The path thus would extend from the board 16 to the heat sink to the reflector surface. Heat generated by the LED assembly on substrate 16 can also be dissipated through conduction outward though the reflector housing.

Electrical driver board 22 may have individual electronic components which are designed to be energized by an alternating current (AC) or direct current (DC) voltage. In one embodiment of the present invention, electrical driver board 22 may include the necessary electronic components to convert the standard 120 volt AC (60 Hertz) signal to a direct current (DC) voltage appropriate for direct current driven LEDs mounted on LED array 16.

Electrical driver board 22 may also include the appropriate electronic components to alter the luminous flux output of the LEDs (commonly measured in units of lumens) and also modify the so-called color temperature of the white light LED device 10. The color temperature, commonly stated in units of degrees Kelvin, is a measure of the peak wavelength of light emitted from a radiating body. It is commonplace in the light bulb industry to refer to incandescent white light devices that have a color temperature in the range of 2800 to 3200 degrees Kelvin as being a "warm" color, whereas compact fluorescent lighting devices which typically have a color temperature in the range of 5800 to 6200 degrees Kelvin are referred to as being a "cool" color.

Electrical driver board 22 may be configured to alter the color temperature of white light LED device 10 by varying the ratio of the steady state direct current (DC) voltages to the individual blue light emitting diodes. For example, to generate a more "warm" color in the range of 2800 to 3200 degrees Kelvin, the electronic components on circuit board 22 may be chosen to deliver slightly more current to the warm LEDs than to the cool LEDs. Similarly, to generate a more "cool" color similar to a compact fluorescent bulb, the electronic components on circuit board 22 may be chosen to deliver slightly more current to the cool LEDs than to the warm LEDs.

In one example embodiment, the electronic components on circuit board 22 may be configured to receive a remote command via a wireless RF link or equivalent means, to alter the current to individual blue LEDs. Given this, both the luminous flux output (measured in Lumens) of the white light LED device 10 and the color temperature of the white light LED device 10 may be modified via remote control by varying the amplitude and ratio of the currents to the individual warm and cool blue LED's. Diffusing surface 14 may consist of a frosted glass, plastic, or opal like material such that the light emanating from diffusing surface 14 appears uniformly distributed over the surface with no apparent bright spots.

In another example embodiment, the LED devices mounted on circuit board 22 may be compatible with an alternating current (AC) drive voltage. In this configuration, circuit board 22 may be configured to accept a 120-volt AC (60 Hertz) input signal and convert that signal to an AC signal appropriate for the individual LEDs mounted thereon.

In another example embodiment, the LED devices mounted on the LED array 16 may be a mixture of some LEDs compatible with a direct current (DC) drive voltage and other LED devices designed to be driven by an alternating current (AC) drive voltage. In this configuration, circuit board 22 may be configured to supply both the appropriate AC and DC drive voltages to the respective AC and DC LED devices.

In a further example embodiment, the LED devices may be mounted on either a concave or convex surface and with (or without) the optical reflector 12 shown in FIG. 1. By varying the shape of the LED array substrate 16 surfaces from planar to either concave or convex, the overall angular distribution of light emanating from the white light LED device 10 can be varied accordingly. For example, by conceptually deforming the LED array surface 16 from planar to slightly concave may transform the light output to a narrower beam angle (i.e., transitioning the white light LED device 10 from a flood to more of a spot illuminator). Conversely, by conceptually deforming the LED array 16 surface from planar to slightly convex, may transform the light output to a wider beam angle. Taken to one extreme, the convex LED array 16 surface may be a hemispherical shape with a light output that spans 180 degrees or more (in this configuration, it may be advantageous that the white light LED device 10 have no reflector at all).

In yet another embodiment, the optical reflector 12 may be partially or wholly filled with a polymer material. In this embodiment, the polymer material may be in direct physical contact, and/or chemically bonded to the LEDs (or their conformal coating) and function as a moisture and water barrier thereto. The polymer may also function as a diffusing agent, but in all cases it is desirable that the polymer material be partially transparent at visible wavelengths. Candidate polymer materials may include acrylic polymers or copolymers including polymethyl methacrylate. In one embodiment, a suitable polymer has a Shore D hardness rating of ASTM D2240. It also has a heat deflection temperature of 120 degrees Fahrenheit as measured via ASTM D6481. Other polymers and polymer properties can be utilized without departing from the scope of the invention. Other properties can include, but are not limited to impact, optical and thermal performance.

This polymer can also be selected to provide advantageous impact performance properties. Typical lights will break and/or shatter when dropped from a significant height, particularly when dropped on a hard surface. There are many applications, such as in industry and military, where the bulbs will be subject to impacts. Thus, the polymer-filled embodiment of the invention provides for improved resistance to damage from impact in these demanding environments. For example, a device having a reflector filled with the polymer noted in the preceding paragraph has been tested as withstanding more than 30 impacts from a .22 caliber pellet, propelled by $CO_2$ from a distance of eight feet and at an angle of 45 degrees, without degraded performance. This robust or high-integrity embodiment is also advantageous in environments, such as public facilities, where vandalism may occur. The robustness reduces the likelihood of damage from many vandal activities, and reduces the resulting need for frequent replacement to address vandal damage.

The polymer material may also have a fluorescent or phosphorescent material dispersed throughout. In this configuration, it may be possible to alter the light output color.

The light device according to certain embodiments herein also provides for a light-weight device. For example, the weight of an R30 shaped device weighs approximately 141 grams.

Another aspect of certain embodiments of the invention is the provision of a common light engine that is adaptable to a variety of light device (bulb) shapes. Conventional LED-based light devices typically employ a unique configuration of the light generating components for each of the various shapes and sizes being offered. This results in a multiplication of design, manufacturing and inventory efforts, and the associated costs for the same. In contrast, the light engine of certain embodiments of the present invention is adaptable to various device shapes and sizes without the need for physical modification.

As can be seen in FIG. 1A, the light engine, comprising the LED elements on board 16, heat sink 20 and driver board 22, are combinable with a reflector 12 and diffuser 14. The heat sink comprises an outer reflector contact surface 21 that complementarily corresponds in shape and size to the inner surface 13 of the reflector inlet's shape and size. A circumferential flange 23 extending outwardly of the outer surface of the heat sink 20 provides a backstop for mating of the reflector 12 with the light engine. Glue, epoxy or other suitable type of fastener can be used to secure the reflector to the light engine.

The various shapes, types and/or sizes of reflectors can all be configured to have a common inlet size and shape so that the same light engine can be used with each type of reflector. Light output of the light engine can be adjusted by electronic commands to the driver board. The light engine can also receive a suitable insulator 24 and electrical connector 26 corresponding to the particular type, size or shape of light device chosen. Thus, only one configuration of light engine is necessary to provide a wide variety of light device shapes, sizes, outputs and configurations.

The present invention should not be considered limited to the particular examples described above, but rather should be understood to cover all aspects of the invention as fairly set out in the attached claims. Various modifications to the shape and form factors described above, equivalent processes to supplying the appropriate drive voltages to the LEDs, as well as numerous structures to which the present invention may be applicable will be readily apparent to those of skill in the art to which the present invention is directed upon review of the present specification. The following claims are intended to cover such modifications and devices.

What is claimed is:

1. A light assembly comprising a plurality of white-light LEDs, comprising a substrate including a generally planar top surface, the plurality of white-light LEDs disposed on the top surface of the substrate;

an electrical driver board electrically connected to the plurality of white-light LEDs; and a heat sink thermally connected to the substrate and the plurality of white-light LEDs, the electrical driver board being disposed at least partially within the heat sink, wherein the plurality of white-light LEDs cover the substrate top surface in a density of greater than 50 individual LEDs per square inch.

2. The light assembly of claim 1, further comprising a reflector assembly including an inlet aperture, an outlet aperture and defining a focal plane therein, the reflector assembly disposed on the heat sink such that the focal plane is disposed generally adjacent to the plurality of white-light LEDs.

3. The light assembly of claim 1, further comprising a reflector assembly including an inlet aperture, an outlet aperture, an inside reflector surface and defining a focal plane therein, the reflector assembly further defining a horn angle between the inside reflector surface such that optical radiation emanating from the plurality of white-light LEDs reflects at least once off the inner surface of the optical reflector before exiting the outlet aperture.

4. The light assembly of claim 1, wherein the heat sink includes a circumferential outer surface and a circumferential flange extending outwardly from the circumferential outer surface.

5. The light assembly of claim 4, further comprising a reflector assembly including an inlet aperture and an outlet aperture, the inlet aperture comprising an inner circumferential surface sized and shaped to correspond to the outer circumferential surface of the heat sink for disposing the reflector assembly thereon.

6. The light assembly of claim 1, further comprising a reflector assembly disposed on the heat sink, the reflector assembly being filled at least partially with an impact-resistant polymer material.

7. The light assembly of claim 1, wherein the light assembly has a continuous operating temperature of 65 degrees Celsius or lower in a room temperature environment.

8. The light assembly of claim 1, wherein the plurality of white-light LEDs, each comprising a planar area projection on the substrate of less than 2 $mm^2$, are disposed in a series of concentric rings on the substrate with each LED having a major length being oriented along the circumference of the concentric rings.

9. A light assembly comprising a plurality of white-light LEDs, comprising a substrate including a generally planar top surface, the plurality of white-light LEDs disposed on the top surface of the substrate;

an electrical driver board electrically connected to the plurality of white-light LEDs; and a heat sink thermally connected to the substrate and the plurality of white-light LEDs, the electrical driver board being disposed at least partially within the heat sink, wherein the light assembly has a continuous operating temperature of 65 degrees Celsius or lower in a room temperature environment.

10. The light assembly of claim 9, further comprising a reflector assembly including an inlet aperture, an outlet aperture and defining a focal plane therein, the reflector assembly disposed on the heat sink such that the focal plane is disposed generally adjacent to the plurality of white-light LEDs.

11. The light assembly of claim 9, further comprising a reflector assembly including an inlet aperture, an outlet aperture, an inside reflector surface and defining a focal plane therein, the reflector assembly further defining a horn angle between the inside reflector surface such that optical radiation emanating from the plurality of white-light LEDs reflects at least once off the inner surface of the optical reflector before exiting the outlet aperture.

12. The light assembly of claim 9, wherein the heat sink includes a circumferential outer surface and a circumferential flange extending outwardly from the circumferential outer surface.

13. The light assembly of claim 12, further comprising a reflector assembly including an inlet aperture and an outlet aperture, the inlet aperture comprising an inner circumferential surface sized and shaped to correspond to the outer circumferential surface of the heat sink for disposing the reflector assembly thereon.

14. The light assembly of claim 9, further comprising a reflector assembly disposed on the heat sink, the reflector assembly being filled at least partially with an impact-resistant polymer material.

15. The light assembly of claim 9, wherein the plurality of white-light LEDs, each comprising a planar area projection on the substrate of less than 2 $mm^2$, are disposed in a series of concentric rings on the substrate with each LED having a major length being oriented along the circumference of the concentric rings.

16. A light assembly comprising a plurality of white-light LEDs, comprising a substrate including a generally planar top surface, the plurality of white-light LEDs disposed on the top surface of the substrate;

an electrical driver board electrically connected to the plurality of white-light LEDs; and a heat sink thermally connected to the substrate and the plurality of white-light LEDs, the electrical driver board being disposed at least partially within the heat sink, wherein the plurality of white-light LEDs, each comprising a planar area projection on the substrate of less than 2 $mm^2$, are disposed in a series of concentric rings on the substrate with each LED having a major length being oriented along the circumference of the concentric rings.

17. The light assembly of claim 16, further comprising a reflector assembly including an inlet aperture, an outlet aperture and defining a focal plane therein, the reflector assembly disposed on the heat sink such that the focal plane is disposed generally adjacent to the plurality of white-light LEDs.

18. The light assembly of claim 16, further comprising a reflector assembly including an inlet aperture, an outlet aperture, an inside reflector surface and defining a focal plane therein, the reflector assembly further defining a horn angle between the inside reflector surface such that optical radiation emanating from the plurality of white-light LEDs reflects at least once off the inner surface of the optical reflector before exiting the outlet aperture, wherein the heat sink includes a circumferential outer surface and a circumferential flange extending outwardly from the circumferential outer surface.

19. The light assembly of claim 16, further comprising a reflector assembly including an inlet aperture and an outlet aperture, the inlet aperture comprising an inner circumferential surface sized and shaped to correspond to the outer circumferential surface of the heat sink for disposing the reflector assembly thereon.

20. The light assembly of claim 16, further comprising a reflector assembly disposed on the heat sink, the reflector assembly being filled at least partially with an impact-resistant polymer material.

* * * * *